US005636741A

United States Patent [19]

O'Keefe

[11] Patent Number: 5,636,741

[45] Date of Patent: Jun. 10, 1997

[54] PRODUCT PACKAGE HAVING MULTIPLE IMAGE VIEWER

[75] Inventor: William R. O'Keefe, Redondo Beach, Calif.

[73] Assignee: Mattel, Inc., El Segundo, Calif.

[21] Appl. No.: 385,617

[22] Filed: Feb. 9, 1995

[51] Int. Cl.[6] ..... B65D 73/00; A63H 17/06

[52] U.S. Cl. ..... 206/459.1; 206/457; 206/751; 206/769; 446/73; 40/312; 40/493

[58] Field of Search ..... 206/459.1, 459.5, 206/457, 45.31, 45.13, 579, 45.33, 232; 40/492, 493, 495, 312; 446/72, 73, 76; 229/162

[56] References Cited

U.S. PATENT DOCUMENTS

| | | | |
|---|---|---|---|
| 968,721 | 8/1910 | Weingart | 40/492 |
| 1,041,573 | 10/1912 | Baring-Gould . | |
| 1,451,251 | 4/1923 | Biggs . | |
| 2,009,509 | 7/1935 | Megdall . | |
| 2,283,628 | 5/1942 | Greenwood . | |
| 2,351,469 | 2/1943 | Allen | 229/162 |
| 2,500,106 | 3/1950 | Wehr . | |
| 2,573,625 | 10/1951 | Swart . | |
| 2,728,167 | 12/1955 | Knott . | |
| 2,791,998 | 5/1957 | Decker . | |
| 3,318,040 | 5/1967 | Kinberg . | |
| 3,392,823 | 7/1968 | Green et al. | 206/45.33 |
| 4,308,880 | 1/1982 | Graves . | |
| 4,585,123 | 4/1986 | Penry | 206/459.1 |
| 4,865,574 | 9/1989 | Kobayashi | 446/152 |
| 4,925,087 | 5/1990 | Ostrander | 206/459.5 |
| 5,142,384 | 8/1992 | Wood | 206/459.1 |
| 5,370,223 | 12/1994 | Leight | 206/232 |
| 5,383,808 | 1/1995 | DuBois | 446/78 |

FOREIGN PATENT DOCUMENTS 1191298 10/1959 France .

*Primary Examiner*—Paul T. Sewell
*Assistant Examiner*—Luan K. Bui
*Attorney, Agent, or Firm*—Roy A. Ekstrand

[57] ABSTRACT

A product package includes a generally rectangular box having a front face which defines a viewing aperture on one side and an elongated aperture on the opposite side. A pivot pin is secured intermediate the two apertures and closer to the elongated aperture. A generally planar image support is pivotally secured within the package interior by the pivot pin and includes a pair of image areas movable into alignment with the viewing aperture in response to rotational position of the image support. A finger aperture is defined within the image support and is accessible through the elongated aperture to permit pivotal movement and control of the image support position. The images formed upon the image support depict alternative configurations of a multiconfiguration or transformable toy product packaged within the box.

5 Claims, 2 Drawing Sheets

PRODUCT PACKAGE HAVING MULTIPLE IMAGE VIEWER

FIELD OF THE INVENTION

This invention relates generally to product packages and particularly to product packages utilized in multiple configuration products such as toys.

BACKGROUND OF THE INVENTION

Consumer product manufacturers often expend substantial effort and expense in providing packaging for their various products which attract potential purchasers. The general objective in addition to attracting potential purchasers is to provide the maximum of product exposure to create sufficient interest on the part of the potential purchaser to sell the product. As a result, product manufacturers have endeavored to provide packaging which is multiply colored with images relating to the product and its use. One of the most challenging and highly competitive consumer product industries which aggressively engages in creative product packaging is the toy industry. In attempting to attract purchasers, toy manufacturers frequently go to great lengths to provide attractive product displays and packages which provide substantial viewing windows to highlight the product. An extremely effective packaging tact utilizing a great deal in the toy industry is the so-called "try-me" packaging. While the types of try-me packaging provided by manufacturers has varied, the most typical utilize a package having the product secured within and having at least one transparent viewing window to afford product exposure. In addition, some type of product access or availability is provided by the potential purchaser is able to intrude into the package and activate the toy product therein in order to observe and listen to its operation. This particular packaging method has enjoyed great success in a variety of sound producing or battery-powered types of toys. The advantage is apparent in that the consumer is able to actually observe the product performance.

While so-called try-me packaging works well with a variety of products, certain products by their nature are not practical for packaging within try-me type containers. For example, products which undergo configuration changes or so-called "transformable" type products often undergo size changes during reconfiguration which renders try-me type packaging impractical. In addition, the manipulation of such transformable toy products in try-me type packaging has proven difficult if not impossible.

In other related arts such as advertising devices or the like, practitioners have similarly endeavored to provide attractive displays aimed at arousing the interest of potential consumers. For example, U.S. Pat. No. 1,041,573 issued to Baring-Gould sets forth an ADVERTISING CARD having a planar card supporting an image including the upper torso and head of a man in profile. A bent arm is pivotally secured to the shoulder portion of the image in a resilient fashion and supports a profile of a top hat. The arm is movable to provide the appearance of the man removing and replacing his hat.

U.S. Pat. No. 1,451,251 issued to Biggs sets forth a COMBINATION STRING HOLDER AND ADVERTISING DEVICE in which a housing supports a quantity of string together with a movable sign which is frictionally engaged to the string and which is moved as string is withdrawn from the housing.

U.S. Pat. No. 2,009,509 issued to Megdall sets forth a ROTATING ALBUM MIRROR having a planar mirror defining an aperture through the silvered backing thereof through which an underlying image is observable. A disk is rotatably supported behind the mirror silvered backing and bears a plurality of images each rotatable into alignment with the viewing window.

U.S. Pat. No. 2,283,628 issued to Greenwood sets forth a SLEEP INDUCER having a paddle supporting a pair of opposed outwardly extending ends and having an image supported thereon. A simulated animal such as sheep is pivotally attached to the paddle and includes a finger hole therethrough for pivoting the simulated animal.

U.S. Pat. No. 2,500,106 issued to Wehr sets forth an ANIMATED DISPLAY having a planar display upon which a pair of images are supported together with a plurality of overlying movable image components each pivotally secured to the image which when moved provide the appearance of articulation of the image.

U.S. Pat. No. 2,573,625 issued to Swart sets forth an ADVERTISING DEVICE having a display upon which an image of the upper portion of a cartoon character is drawn. A rotatable member having simulated legs is pivotally secured to the display and rotates to provide the appearance of moving legs in a running or walking action.

U.S. Pat. No. 2,727,167 issued to Knott sets forth a TOY FOR FORMING GROTESQUE FIGURES having a planar board defining a center aperture behind which a plurality of rotatable disks are overlappingly supported. Each disk supports a plurality of facial portions and the disks are rotatable to provide varying combinations of facial elements in the person formed in composite within the window.

U.S. Pat. No. 2,791,998 issued to Decker sets forth a NIGHT LAMP having a cylindrical drum-like housing defining a rectangular aperture therein. A cylindrical image roll is rotatably supported within the drum and bears a plurality of images thereon which are moved past the window as the internal image bearing drum rotates.

U.S. Pat. No. 3,318,040 issued to Kinberg sets forth a MOVABLE FIGURE CARD TOY having a planar card defining a pair of apertures through which underlying images are viewed. A pair of finger apertures are further provided which expose finger apertures in the image bearing card. The image bearing card is slidably movable within the housing card to articulate the images within the window frames.

U.S. Pat. No. 4,308,880 issued to Graves sets forth a ANIMATED DENTAL FLOSS DISPENSER having a housing supporting a quantity of dental floss therein. The housing defines an image facet bearing a fanciful face and a plurality of movable image members frictionally coupled to the dental floss roll and moved in response to dental floss being withdrawn from the housing.

French Patent 1,191,298 issued to Andre sets forth a postal package having a transformable illustration including a viewing aperture behind which a circular disk is pivotally supported. The disk is rotatable to selectively align a portion of the disk with the viewing window to expose a selected image through the viewing window.

While the foregoing described prior art devices have provided some commercial success and improvement in the art, there remains nonetheless a continuing need in the art for evermore improved and interesting packaging for transformable products such as toys or the like.

SUMMARY OF THE INVENTION

Accordingly, it is a general object of the present invention to provide an improved product package. It is a more particular object of the present invention to provide an improved product package having a multiple image viewer which facilitates display of a transformable toy product in its various multiple configurations.

In accordance with the present invention, there is provided for use in packaging a product configurable in alternative appearances, a package comprising: a generally rectangular box having an interior for receiving the product and a front, the front defining an elongated aperture and a viewing aperture; an image support defining a generally planar member having at least two image areas alternatively alignable with the viewing aperture and a finger aperture alignable with the elongated aperture; a plurality of images formed upon the image areas each depicting the product in different ones of the alternative appearances; a pivotal attachment pivotally attaching the image support to the front such that the finger aperture underlies the elongated aperture and the image areas selectively underlie the viewing aperture; and a plurality of limit edges formed on the image support for maintaining the pivotal position of the image support within a predetermined limit.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
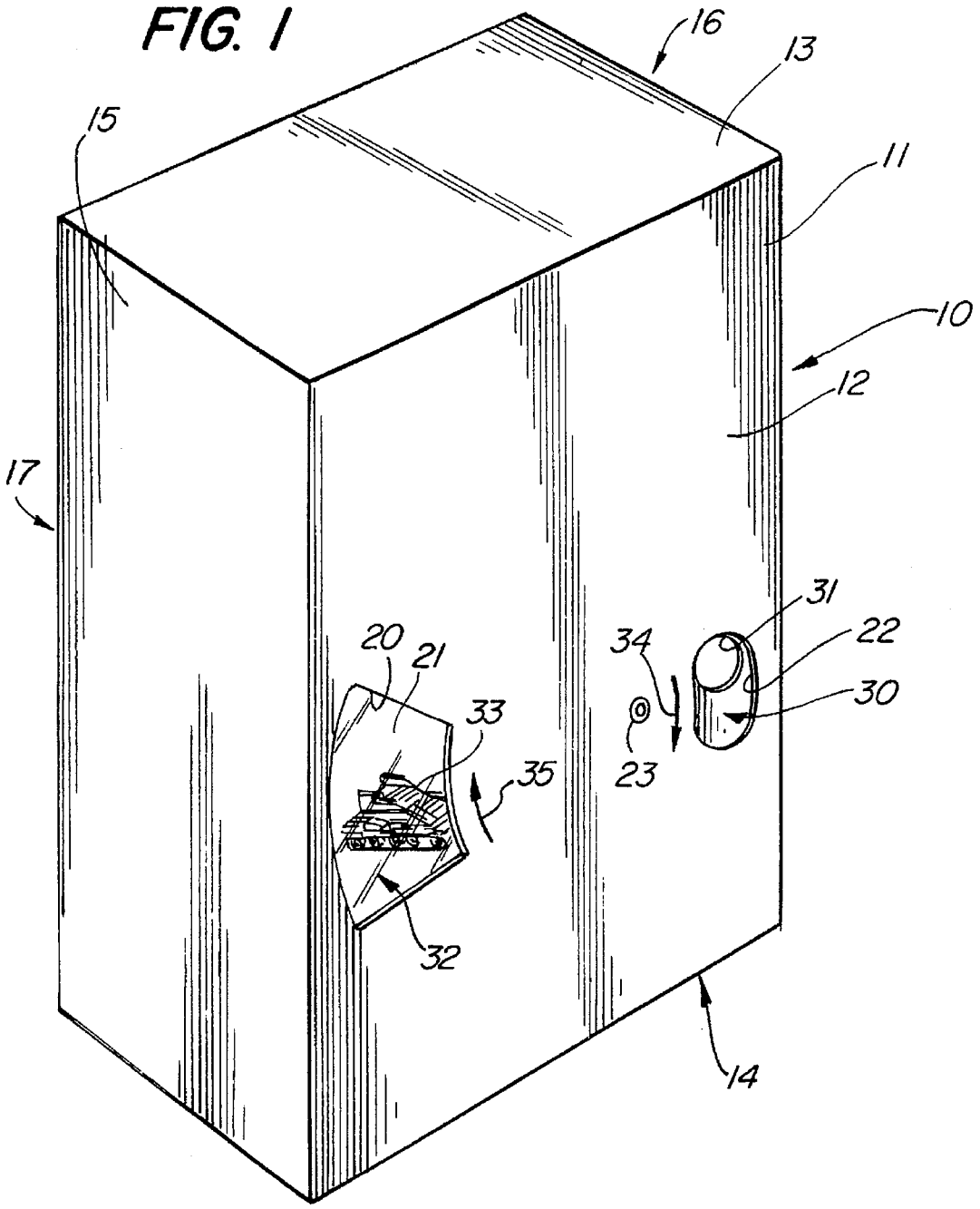
FIG. 1 sets forth a front perspective view of a product package constructed in accordance with the present invention.

FIG. 1 sets forth a front perspective view of a product package constructed in accordance with the present invention and generally referenced by numeral 10. Package 10 includes a generally rectangular box 11 having a front face 12, a top face 13, a bottom face 14, a pair of side faces 15 and 16 and a rear face 17. In accordance with the present invention, front face 12 defines a viewing aperture 20 having a clear transparent cover 21 extending thereacross. In further accordance with the present invention, front face 12 defines an elongated aperture 22.

Figure 3:
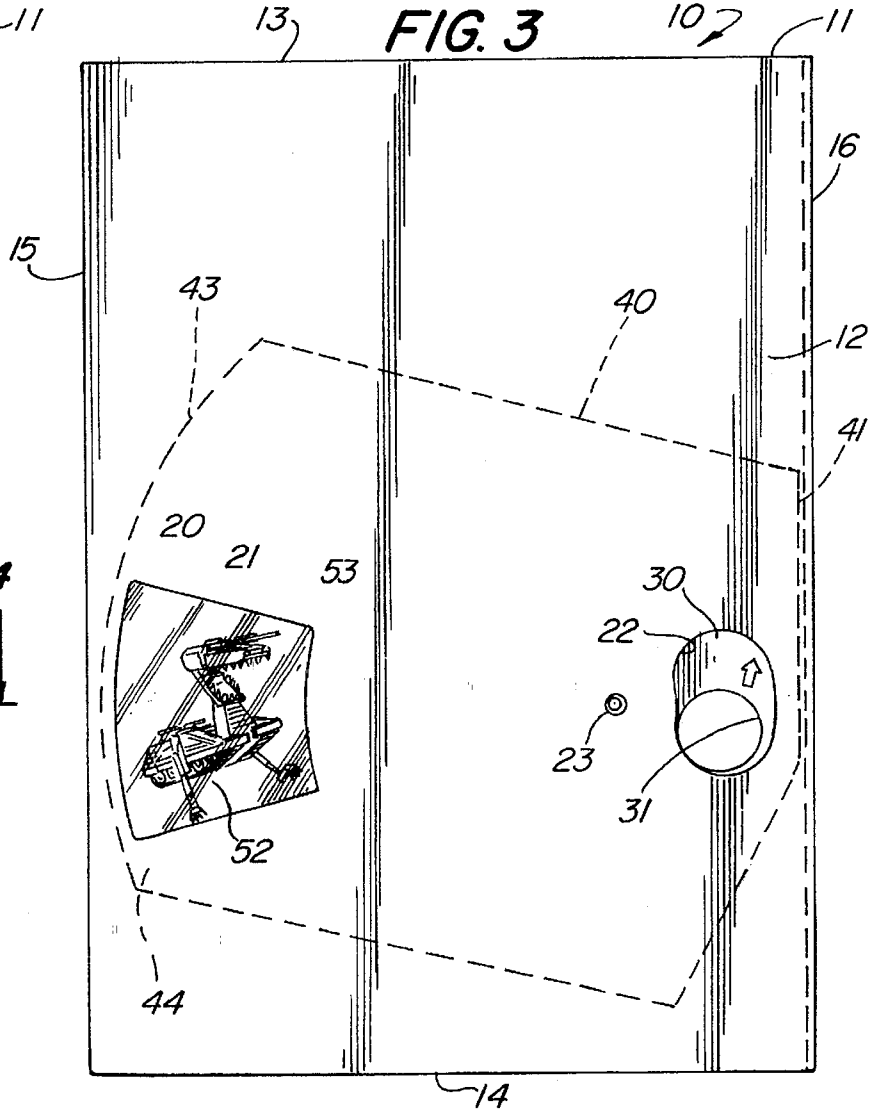
FIG. 3 sets forth a front view of the present invention package in its alternative product viewing configuration.
Figure 2:
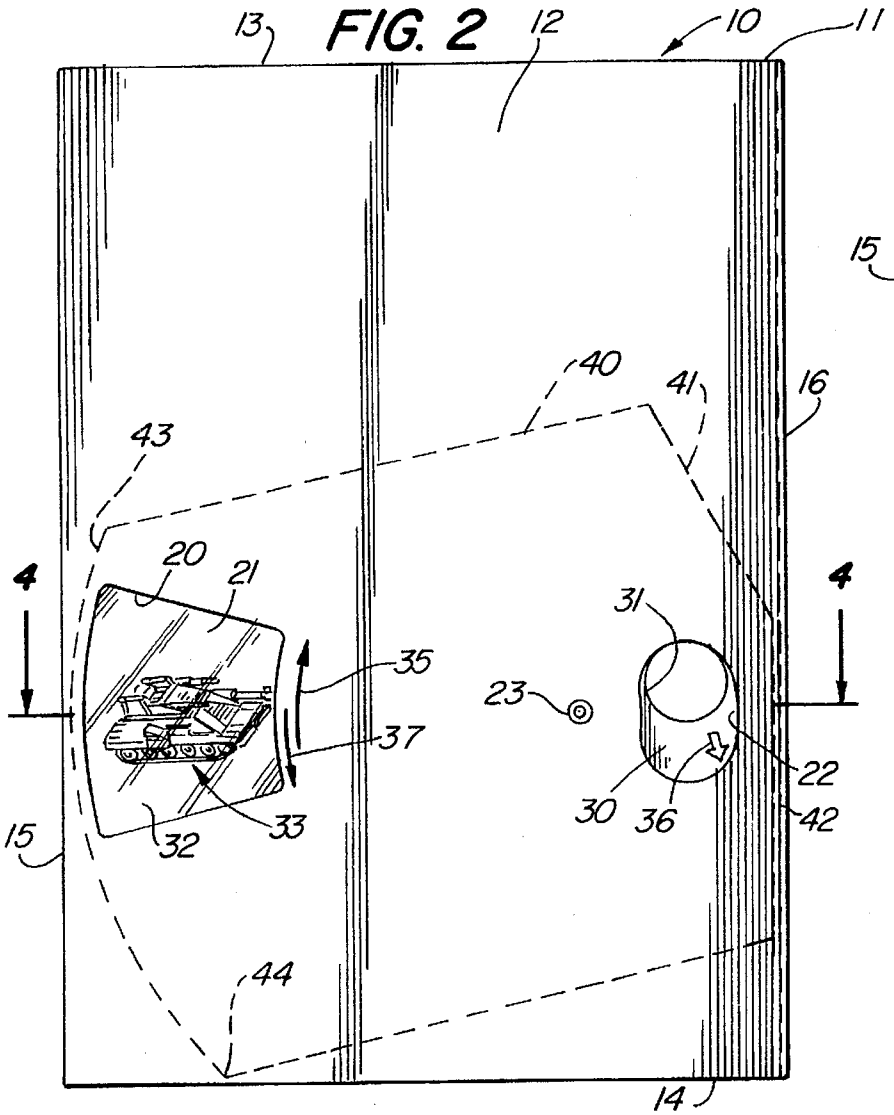
FIG. 2 sets forth a front view of the present invention product package in one viewing configuration.

In further accordance with the present invention and as is described below in greater detail, package 10 includes an image support 30 pivotally secured within box 11 against the interior surface of front face 12 by a pivot 23. Image support 30 extends beneath aperture 22 and defines a finger aperture 31. Image support 30 further extends beyond pivot 23 and underlies viewing aperture 20 defining an image area 32. An image 33 is formed upon image area 32 and is viewable through transparent cover 21 and viewing aperture 20. In further accordance with the present invention, image 33 depicts the product packaged within package 10 in one of its multiple configurations. Thus, the user is able to observe image 33 through transparent cover 21 and viewing aperture 20 to examine the appearance of the product within package 10 in the configuration shown. In further accordance with the present invention, the user is in addition able to insert a finger through aperture 22 and into finger aperture 31 and thereafter pivot image support 30 downwardly about pivot 23 in the direction indicated by arrow 34 which in turn pivots the opposite end of image support 20 upwardly in the direction indicated by arrow 35 moving image area 32 upwardly through viewing aperture 20 and thereafter as is shown in FIGS. 2 and 3 exposes an alternate image area to the consumer through transparent cover 21 and viewing aperture 20. Once the user releases image support 30, the offset position of pivot 23 and the weight distribution of image support 30 causes image support 30 to return to the position shown in FIG. 1.

Thus, the consumer is able to view alternative images of the product within the present invention package despite the substantial variations in size which might be represented in the various multiple configurations of the product.

In accordance with an important aspect of the present invention, image 33 is a pictorial representation of the product in one configuration. Thus the direct relationship between image 33 and the product enclosed within package 10 (not shown) facilitates the evaluation of the visual aspects of the product in one configuration without the need for large transparent windows or the like which are generally provided for such toy products. In addition and as is set forth below in FIGS. 2 and 3 in greater detail, an important aspect of the present invention is realized in connection with products which undergo substantial size changes or geometric form changes as they are transformed between alternative configurations. Prior to the creation of the present invention package, it was virtually impossible for toy manufacturers to provide any consumer involved transformation of the product within a conventional package. Thus, practitioners in the past have been limited to providing pictorial representations on the various facets of the package showing the different configurations. While such pictorial representations may be amply provided upon the present invention package since substantial space remains available in the example shown in FIG. 1 on virtually all sides of box 11, the additional aspect of a consumer involved viewing as the consumer switches back and forth between images viewable through aperture 20 and transparent cover 21 greatly increases the enticement value of the present invention package. It will be apparent to those skilled in the art while commercial economics and present manufacturing capabilities would encourage the fabrication of package 10 from pressed board or cardboard or other composite paper-like materials, other materials may be utilized without departing from the spirit and scope of the present invention. For example, box 11 may be fabricated of a thin molded plastic shell having a convenient closure for inserting and retrieving the product from the interior thereof without departing from the spirit and scope of the present invention. It should also be noted that while a rectangular prism-shaped six sided box is shown in the example set forth in FIGS. 1 through 4, other differently shaped boxes may be utilized without departing from the spirit and scope of the present invention. Thus, boxes which are triangular prisms, pyramid-shaped prisms, cylindrical drums or other shapes may be utilized without departing from the spirit and scope of the present invention.

FIGS. 2 and 3 set forth front views of the present invention package differing solely in the position of image support 30 within the package. Thus, in the absence of finger manipulation of image support 30 as described above, the weight distribution of image support 30 and the shape thereof within the present invention package cause image support 30 to assume the position shown in FIG. 2 which in turn aligns image 33 within viewing aperture 20. Conversely, FIG. 3 depicts the alternate position of image support 30 within box 11 achieved by the user inserting a finger into aperture 31 of image support 30 and forcing it downwardly to align image 53 within the viewing aperture.

More specifically and with reference to FIG. 2, package 10 includes a box 11 having a rectangular front face 12 defining a viewing aperture 20 and an elongated aperture 22. Viewing aperture 20 is covered with a clear transparent plastic cover 21 secured to the interior side of front 12 using conventional adhesive attachment apparatus or the like. An elongated image support 30 shown in dashed-line representation by outer edge 40 is pivotally secured to the interior surface of front 12 in the manner shown in FIG. 4 by a pivot pin 23. Pivot pin 23 in its preferred form comprises a conventional rivet or the like. Image support 30 defines a finger aperture 31 aligned with aperture 22 and an image area 32 positioned to underlie aperture 20 when image support 30 is placed in the position shown in FIG. 2. With temporary reference to FIG. 3, it should be noted that image support 30 further supports a second image area 52 beneath image area 32 which is moved into alignment with viewing aperture 20 when image support 30 is pivoted about pin 23 in the manner shown in FIG. 3.

Returning to FIG. 2, image area 32 includes an image 33 which in accordance with an important aspect of the present invention depicts the product packaged within box 10 in one of its alternate configurations. Thus, image 33 is fully viewable through aperture 20 and transparent cover 21 each time image support 30 is positioned in the manner shown in FIG. 2. It should be further noted that image support 30 defines angular edges 41 and 42 on one side of pivot 23 and a curved portion 43 on the opposite side of pivot 23 beyond image areas 32 and 52. In addition, image support 30 defines a longer corner 44. In accordance with an important aspect of the present invention, pivot 23 is offset from the center of gravity of image support 30 and is positioned closest to the side of image support 30 forming finger aperture 31. As a result, in the absence of user manipulation of finger aperture 30, the off balance weight distribution of image support 30 pivots image support 30 downwardly in the direction indicated by arrow 37 until the further pivotal motion of image support 30 is precluded by either of two limit stop mechanisms. In the mechanism shown in FIG. 2, corner 44 of image support 30 contacts the interior surface of bottom 14 of box 11 acting as a limit stop. In applications in which box 11 is longer or in which pivot 23 and apertures 20 and 22 are formed farther from the bottom surface, the contact of edge 42 against the interior of side 16 provides a similar travel limit in the direction of arrow 37 for image support 30. In either event, image area 32 is positioned upon image support 30 such that it underlies aperture 20 and centers image 33 within aperture 20 in the travel limit position produced either by corner 44 or edge 42.

In the event the user wishes to now view the alternative image of the product within package 10, the user simply inserts a finger into aperture 31 and pushes it downwardly within elongated aperture 22 in the direction indicated by arrow 36. This downward movement pivots image support 30 upwardly in the direction indicated by arrow 35 bringing image area 52 into alignment with aperture 20 in the manner shown in FIG. 3.

FIG. 3 sets forth the same frontal view of package 10 with the sole difference being the rotation of image support 30 to display alternate image area 52 and image 53 within aperture 20. Thus, with the user's finger maintained within aperture 31 and with downward pressure upon image support 30, image area 52 is aligned with viewing aperture 20 and image 53 which depicts the alternate configuration of the toy product within box 11 is shown. The user therefore is able to view the alternate configurations of the transformable product within box 11 in a simulated "try-me" mode of product inspection which is a substantial improvement over the reliance solely upon external pictures on the various package faces.

With concurrent reference to FIGS. 2 and 3, it will be apparent that the user is simply able to move back and forth between images 33 and 53 for comparison purposes and for inspection of the transformable product. In the event package 19 is oriented vertically in the manner shown in FIG. 2, the off balance weight distribution of image support 30 and off center position of pivot 23 cause image support 30 to return to the position shown in FIG. 2 each time the consumer releases finger engagement with finger aperture 31. In the event, however, package 10 is placed upon rear surface 17 (seen in FIG. 1) and oriented horizontally, the gravitational effect upon image support 30 is changed and image support 30 simply remains in either selected position without continued engagement of the user's finger.

Figure 4:
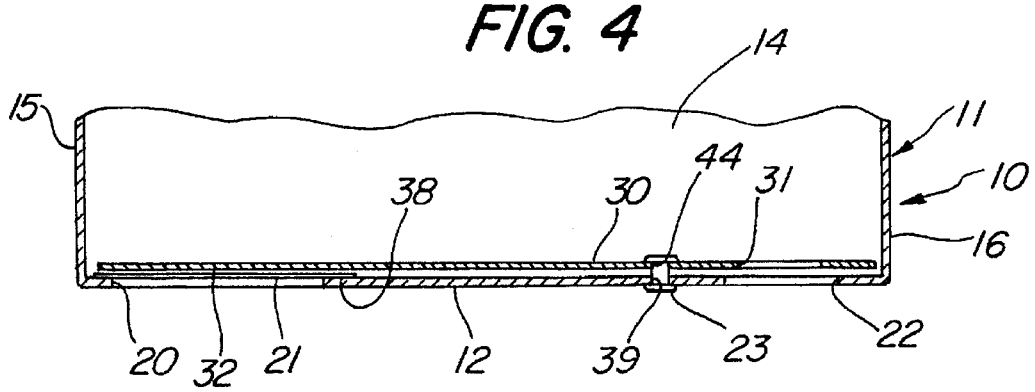
FIG. 4 sets forth a partial section view of the present invention product package taken along section lines 4—4 in FIG. 2.

FIG. 4 sets forth a section view of package 10 taken along section lines 4—4 in FIG. 2. As described above, package 10 includes a box 11 having a front 12, sides 15 and 16 and a bottom 14. Front 12 defines an elongated aperture and a viewing aperture 20. A transparent plastic cover 21 is secured to the interior surface of front 12 using a conventional adhesive bond 38 or other attachment means. Front 12 further defines an aperture 22 and an aperture 39. In accordance with the present invention, package 10 includes a generally planar image support 30 having a finger aperture 31 formed therein and a smaller aperture 44 generally aligned with aperture 39 in front 12. As described above, image support 30 includes an image area 32 generally aligned with viewing aperture 20 which in turns supports an image 33 (seen in FIG. 2). A pivot 23 comprising a conventional rivet extends through apertures 39 and 44 and provides a pivot attachment for image support 30. It will be apparent to those skilled in the art that other attachment pivots may replace the rivet used in pivot 23 such as molded plastic fasteners or the like. It should be noted from examination of FIG. 4 that the present invention package and its provision of image support 30 consumes very little interior space within box 11 and thus is extremely efficient and effective as a packaging enhancement.

What has been shown is a product package having a novel apparatus for providing selective viewing of images corresponding to the product packaged within the package depicting the product in alternative configurations. The present invention package is particularly advantageous when utilized in packaging products which are transformable and therefore which undergo substantial manipulation and reconfiguration as they are changed between alternative shapes and configurations. The product package provides a novel simulation of the "try me" feature. Thus the present invention product package overcomes the difficulties in providing some sort of try me feature for transformable or reconfigurable type toys.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in packaging a product configurable in alternative appearances, a package comprising:

a generally rectangular box having an interior for receiving said product and a front, said front defining an elongated aperture and a viewing aperture;

an image support defining a generally planar member having at least two image areas alternatively alignable with said viewing aperture and a finger aperture alignable with said elongated aperture;

a plurality of images formed upon said image areas each depicting said product in different ones of said alternative appearances;

a pivotal attachment pivotally attaching said image support to said front such that said finger aperture underlies said elongated aperture and said image areas selectively underlie said viewing aperture; and a plurality of limit edges formed on said image support for maintaining the pivotal position of said image support within a predetermined limit.

2. A package as set forth in claim 1 wherein said front defines an interior surface and wherein said pivotal attachment maintains said image support proximate said interior surface.

3. A package as set forth in claim 2 further including a transparent cover extending across said viewing aperture.

4. A package as set forth in claim 3 wherein said image holder and said front each define aligned apertures and wherein said pivotal attachment includes a post extending through said aligned apertures.

5. A package as set forth in claim 4 wherein said aligned apertures are positioned away from the center of said image support such that gravitational force upon said image support urges it toward one position when released.

* * * * *